US008179347B2

(12) United States Patent
Oh et al.

(10) Patent No.: US 8,179,347 B2
(45) Date of Patent: May 15, 2012

(54) METHOD AND APPARATUS FOR DRIVING LIQUID CRYSTAL DISPLAY

(75) Inventors: Eui Yeol Oh, Kyounggi-do (KR); Ki Duk Kim, Kyounggi-do (KR); Chul Sang Jang, Kyounggi-do (KR)

(73) Assignee: LG Display Co., Ltd., Seoul (KR)

( * ) Notice: Subject to any disclaimer, the term of this patent is extended or adjusted under 35 U.S.C. 154(b) by 810 days.

(21) Appl. No.: 10/878,518

(22) Filed: Jun. 29, 2004

(65) Prior Publication Data

US 2005/0140624 A1 Jun. 30, 2005

(30) Foreign Application Priority Data

Dec. 24, 2003 (KR) ..... 10-2003-0096706

(51) Int. Cl.
*G09G 3/36* (2006.01)

(52) U.S. Cl. ..... 345/89; 348/254

(58) Field of Classification Search ..... 345/89, 345/87; 348/254
See application file for complete search history.

(56) References Cited

U.S. PATENT DOCUMENTS

| | | | | |
|---|---|---|---|---|
| 5,289,565 | A * | 2/1994 | Smith et al. | 345/604 |
| 5,301,017 | A * | 4/1994 | Murakami | 348/645 |
| 6,160,532 | A * | 12/2000 | Kaburagi et al. | 345/87 |
| 7,088,478 | B2 * | 8/2006 | Shirochi et al. | 358/519 |
| 2002/0063666 | A1 * | 5/2002 | Kang et al. | 345/87 |

FOREIGN PATENT DOCUMENTS

| | | |
|---|---|---|
| JP | 10-313416 | 11/1998 |
| KR | 1020020055991 | 7/2002 |

* cited by examiner

*Primary Examiner* — Yong H Sim
(74) *Attorney, Agent, or Firm* — McKenna Long & Aldridge, LLP

(57) ABSTRACT

An apparatus and a method of driving a liquid crystal display device include receiving gamma-treated data, performing a reverse gamma correction of the data, the reverse-gamma-corrected data having a first linear characteristic, performing a signal processing of the reverse-gamma-corrected data having the first linear characteristic, performing a gamma correction of the processed data, and generating data signals based on the gamma-corrected data using analog voltage values, the data signals having a second linear characteristic.

9 Claims, 13 Drawing Sheets

METHOD AND APPARATUS FOR DRIVING LIQUID CRYSTAL DISPLAY

The present invention claims the benefit of Korean Patent Application No. P2003-96706 filed in Korea on Dec. 24, 2003, which is hereby incorporated by reference.

BACKGROUND OF THE INVENTION

1. Field of the Invention

The present invention relates to a liquid crystal display device, and more particularly, to a method and an apparatus for driving a liquid crystal display that perform signal processing on data having a linear characteristic and generate data signals having a linear characteristic to drive a liquid crystal display panel.

2. Discussion of the Related Art

In general, an active-matrix-type liquid crystal display (LCD) device has a switching device for selectively controlling light transmittance of liquid crystal cells in accordance with video signals to thereby display an image. The switching device for the active matrix LCD commonly uses a thin film transistor (TFT).

FIG. 1 is a schematic diagram of a driving apparatus for a liquid crystal display according to the related art. FIG. 2A is a graph representing a gamma value of an input data, and FIG. 2B is a graph representing a gamma value of the gamma voltage supplier according to the related art. In FIG. 1, a driving apparatus includes a liquid crystal display panel 2, a data driver 4, a gate driver 6, a gamma voltage supplier 8, a timing controller 10, and a signal processor 12. The crystal display panel 2 includes m data lines D1 . . . Dm and n gate lines G1 . . . Gn intersecting each other and defining m×n liquid crystal cells Clc arranged in a matrix. Thin film transistors TFT and storage capacitors Cst are formed in the liquid crystal cells Clc.

The signal processor 12 receives data from an input source (not shown) and performs signal processing on the data. In particular, the signal processor 12 receives data having a non-linear characteristic as shown in FIG. 2A. For example, TV signals generally are subject to a 2.2 gamma correction as shown in FIG. 2A such that they have a characteristic contrary to a cathode ray tube (CRT). Thus, the signal processor 12 receives such 2.2-gamma-corrected data having a non-linear characteristic and performs signal processing on the data. Then, the signal processor 12 applies the processed data to the timing controller.

The timing controller 10 re-arranges the processed data received from the signal processor 12, and applies the data to the data driver 4. In addition, the timing controller 10 receives a synchronizing signal from the input source (not shown) to generate a data control signal DCS and a gate control signal GCS for controlling the data driver 4 and the gate driver 6. Thus, the timing controller 10 also applies the data control signal DCS to the data driver 4, and the gate control signal GCS to the gate driver 6.

The data driver 4 then generates data signals using analog gamma voltages supplied from the gamma voltage supplier 8 and the data from the timing controller 10. In particular, the gamma voltage supplier 8 applies a plurality of analog gamma voltages having characteristics as shown in FIG. 2B, to linearly display 2.2 gamma-corrected data on the liquid crystal display panel 2. Thus, the data signals applied to the liquid crystal display panel 2 have a linear characteristic.

Further, the gate driver 6 sequentially applies a scanning pulse to the gate lines G1 . . . Gn in response to the gate control signal GCS to thereby select horizontal lines of the liquid crystal display panel 2 to display an image.

In the LCD according to the related art, the signal processor 12 changes 2.2 gamma-corrected data as shown in FIG. 2A to thereby improve display quality. However, there is a limit in making a signal processing using the gamma-treated data having a different input-to-output ratio. More specifically, when data is changed by the signal processor 12, data signals to be generated from the data driver 4 still need to have a linear characteristic. Thus, the signal processor 12 has to consider a characteristic of data signals to be generated later and a signal processing is thus limited. Therefore, the LCD according to the related art has a problem that some signal processing for improving a display quality cannot be made.

SUMMARY OF THE INVENTION

Accordingly, the present invention is directed to a method and an apparatus for driving a liquid crystal display that substantially obviate one or more of problems due to limitations and disadvantages of the related art.

An object of the present invention is to provide a driving method and apparatus for a liquid crystal display that provide signal processing on data having a linear characteristic.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the apparatus for driving a liquid crystal display device includes a signal processor receiving gamma-treated data from an input source, and performing a reverse gamma correction on the data, the reverse-gamma-corrected data having a first linear characteristic, and a liquid crystal display panel for receiving data signals generated based on the reverse-gamma-corrected data having the first linear characteristic, the data signals having a second linear characteristic.

In another aspect, the method of driving a liquid crystal display device includes receiving gamma-treated data, performing a reverse gamma correction of the data, the reverse-gamma-corrected data having a first linear characteristic, performing a signal processing of the reverse-gamma-corrected data having the first linear characteristic, performing a gamma correction of the processed data, and generating data signals based on the gamma-corrected data using analog voltage values, the data signals having a second linear characteristic.

In another aspect, the method of driving a liquid crystal display includes receiving gamma-treated data, performing a reverse gamma correction of the data, the reverse-gamma-corrected data having a linear characteristic, performing a signal processing of the reverse-gamma-corrected data having the linear characteristic, and generating data signals based on the processed data using analog voltage values corresponding to gamma values having a linear characteristic, wherein the data signals have a linear characteristic.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments, examples of which are illustrated in the accompanying drawings.

Figure 3:
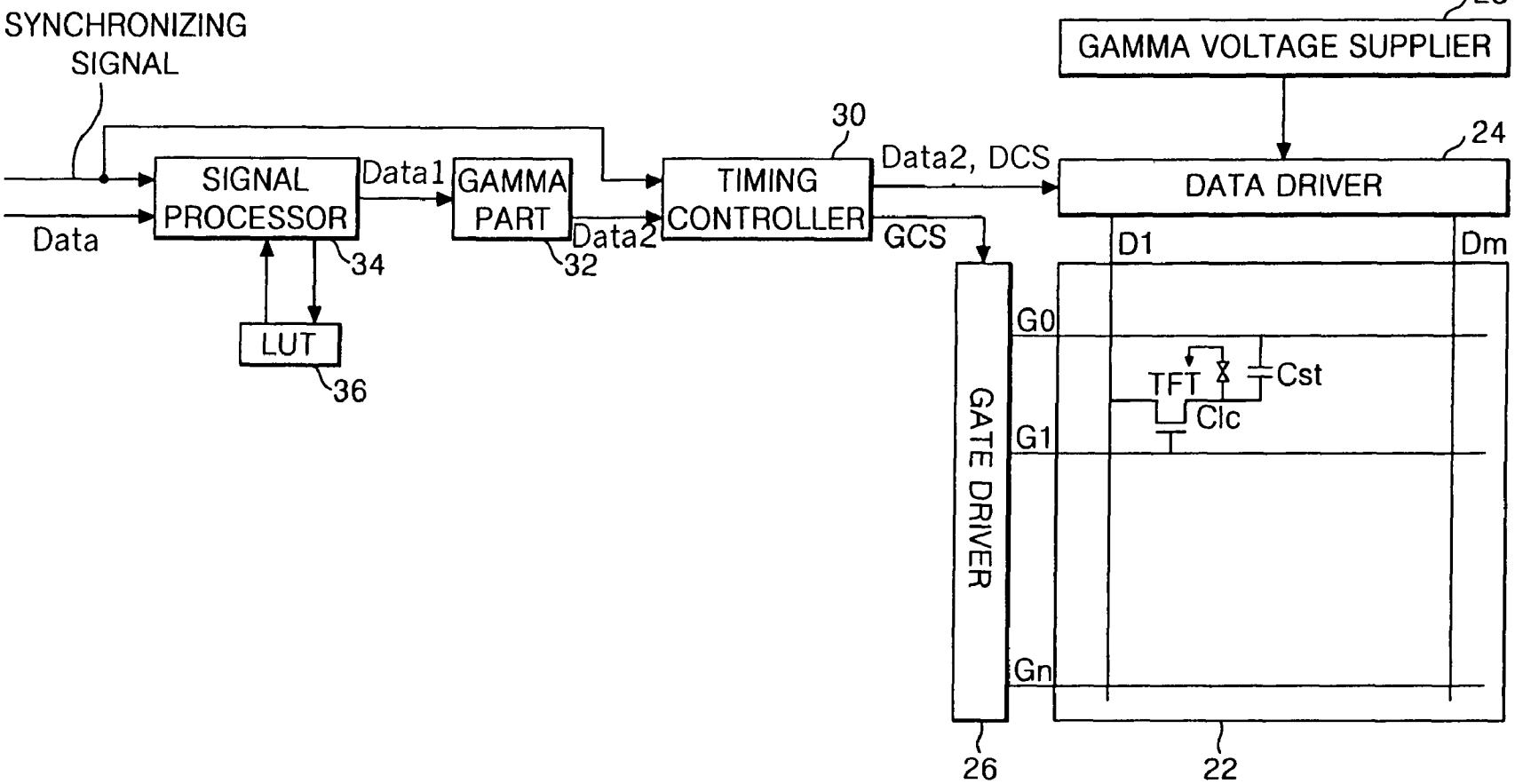
FIG. 3 is a schematic diagram of a driving apparatus for a liquid crystal display device according to an embodiment of the present invention.

FIG. 3 is a schematic diagram of a driving apparatus for a liquid crystal display device according to an embodiment of the present invention. In FIG. 3, a driving apparatus for a liquid crystal display device may include a liquid crystal display panel 22, a data driver 24, a gate driver 26, a gamma voltage supplier 28, a timing controller 30, a signal processor 34, a look-up table (LUT) 36, and a gamma part 32.

The liquid crystal display panel 22 may include m data lines D1 . . . Dm and n gate lines G1 . . . Gn intersecting each other and defining m×n liquid crystal cells Clc arranged in a matrix. The liquid crystal display panel 22 may include a dummy gate line G0. In addition, the liquid crystal display panel 22 may also include thin film transistors TFT and storage capacitors Cst at the m×n liquid crystal cells Clc. The thin film transistors TFT may selectively apply a data signal from the data lines D1 . . . Dm to the respective liquid crystal cells Clc in response to a scanning signal from the gate lines G1 . . . Gn, thereby displaying an image.

Figure 1:
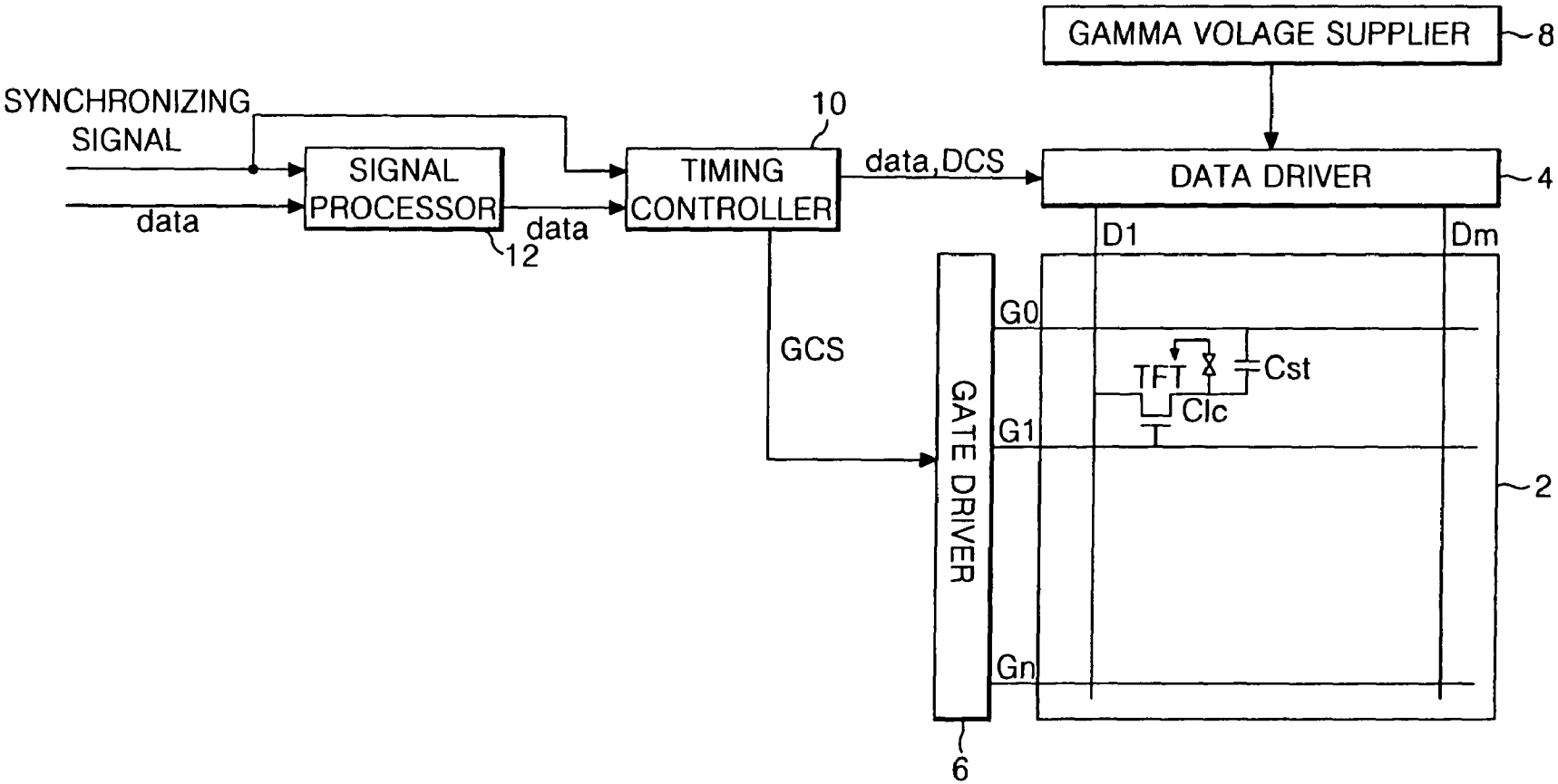
FIG. 1 RELATED ART
FIG. 1 is a schematic diagram of a driving apparatus for a liquid crystal display according to the related art.
Figure 2A:
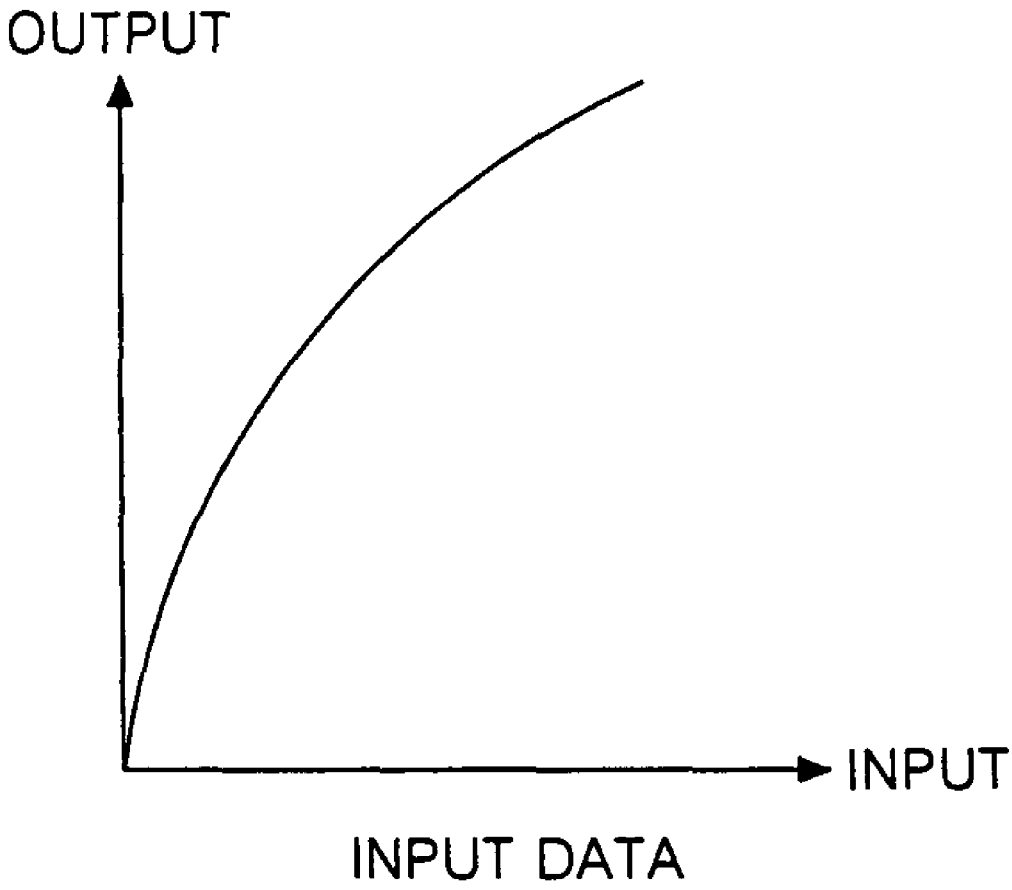
FIG.2A RELATED ART
FIG. 2A is a graph representing a gamma value of an input data.
Figure 2B:
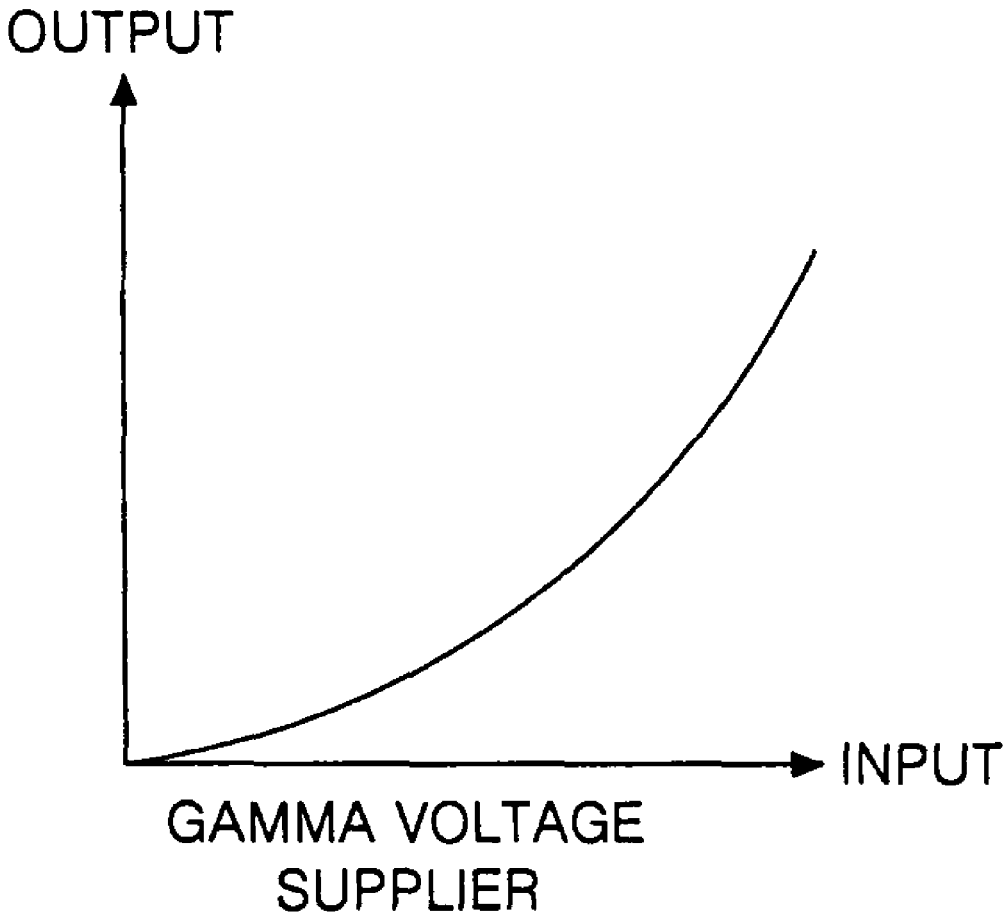
FIG.2B RELATED ART
FIG. 2B is a graph representing a gamma value of the gamma voltage supplier according to the related art.

In addition, the signal processor 34 may receive gamma-treated data Data having a non-linear characteristic as shown in FIG. 2A from an input source (not shown) and may perform a reverse gamma correction to generate processed data Data1 having a linear characteristic. The signal processor 34 may use a reverse gamma table stored in the LUT 36 to perform the reverse gamma correction.

Further, before outputting the processed data Data1, the signal processor 34 may perform other signal processing on the reverse-gamma-corrected data, such as adjusting a gain of the data to improve display quality. In particular, types of the signal processing performed by the signal processor 34 need not be restricted because the data undergoing the signal processing have a linear characteristic and may later be converted to a different format, if needed. After performing signal processing on the data, the signal processor 34 may provide the processed data Data1 to the gamma part 32.

The gamma part 32 may provide a gamma correction to generate gamma-corrected data Data2. In particular, a gamma characteristic of the gamma part 32 may be complementary to a gamma characteristic of the gamma voltage supplier 28. For instance, the gamma part 32 may provide a gamma correction using a 2.2 gamma and the gamma voltage supplier 28 may provide a reverse gamma correction using a reverse gamma value complementary to the 2.2 gamma. As a result, the combination of gamma characteristics of the gamma part 32 and the gamma voltage supplier 28 may provide a linear characteristic for the data. Then, the gamma-corrected data Data2 from the gamma part 32 may be applied to the timing controller 30.

The timing controller 30 may apply the gamma-corrected data Data2 to the data driver 24. In addition, the timing controller 30 may receive a synchronizing signal from the input source (not shown) and may generate a data control signal DCS and a gate control signal GCS for controlling the data driver 24 and the gate driver 26, respectively.

The data driver 24 may convert the gamma-corrected data Data2 into data signals corresponding to gray level values in response to the data control signal DCS and may apply the data signals to the data lines D1 . . . Dm. In addition, the data driver 24 may generate the data signals using an analog gamma voltage corresponding to the data of a plurality of analog gamma voltages received from the gamma voltage supplier 28.

The gamma voltage supplier 28 may apply the analog gamma voltages to the data driver 24. For example, the gamma voltage supplier 28 may supply the analog gamma voltages having a reverse gamma characteristic complementary to a gamma characteristic of the gamma part 32, such that the gamma-corrected data from the gamma part 32 can be linearly displayed on the liquid crystal display panel 22. Thus, the data signals applied to the liquid crystal display panel 22 may have a linear characteristic.

Moreover, the gate driver 26 may sequentially apply a scanning pulse to the gate lines G1 . . . Gn in response to the gate control signal GCS to thereby selectively drive horizontal lines of the liquid crystal display panel 22.

Figure 4:
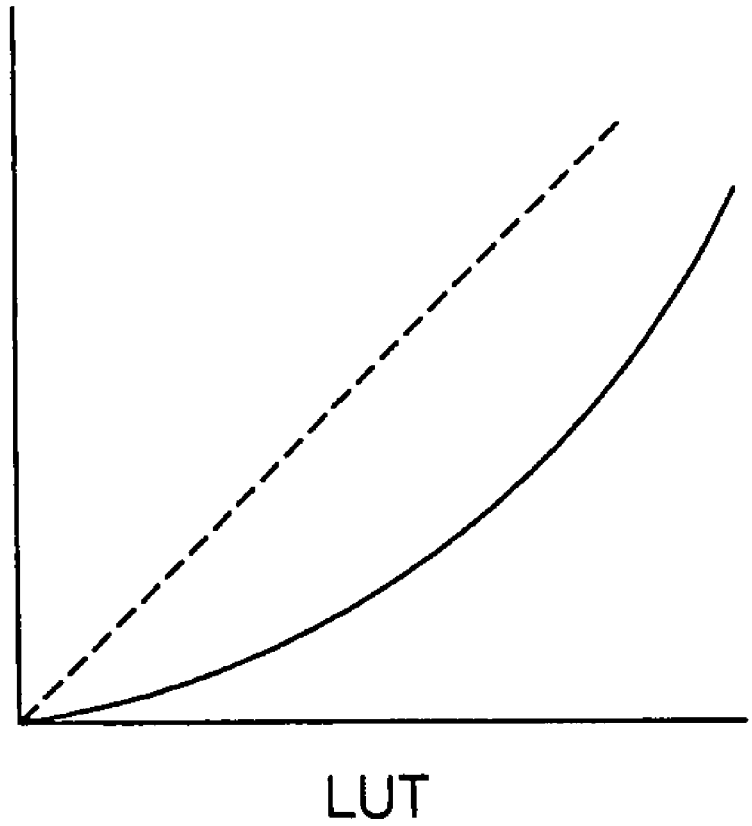
FIG. 4 is a graph representing a gamma value of the look-up table in FIG. 3.

FIG. 4 is a graph representing a gamma value of the look-up table in FIG. 3. As shown in FIG. 4, the LUT 36 may store a gamma value shown as the solid line to transform a gamma-treated data having a non-linear characteristic to a reverse gamma corrected data having a linear characteristic shown as the dotted line.

Figure 5A:
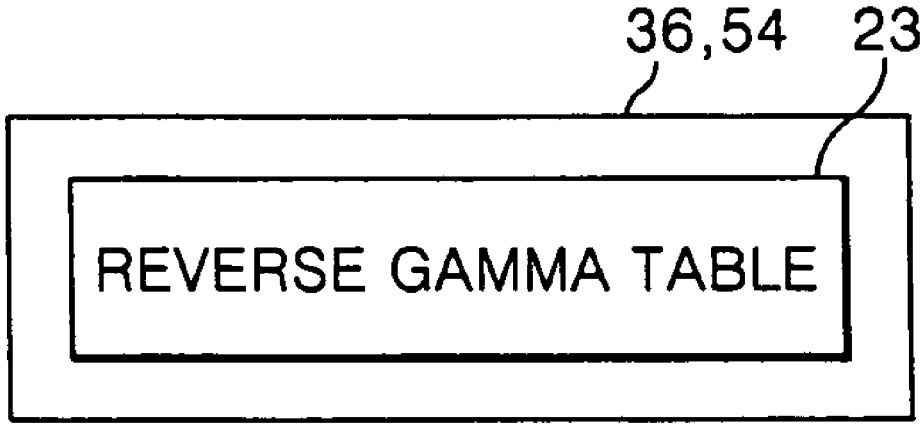
FIG. 5A and FIG. 5B illustrate configurations of the look-up table according to embodiments of the present invention.
Figure 5B:
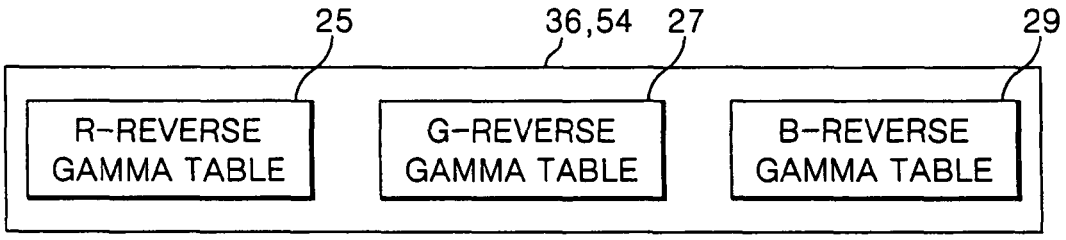

FIG. 5A and FIG. 5B illustrate configurations of the look-up table according embodiments of the present invention. As shown in FIG. 5A, the LUT 36 may include a ROM or an EEPROM, and may include one reverse gamma table 23. Desired reverse-gamma values may be stored in the reverse gamma table 23, e.g., 2.2 gamma-corrected data have a linear characteristic. As a result, the signal processor 34 may provide a reverse gamma correction of red (R), green (G) and blue (B) data using the reverse gamma table 23.

Alternatively, as shown in FIG. 5B, a plurality of reverse gamma tables, 25, 27, and 29, may be stored in the LUT 36. The R-reverse gamma table 25 may correspond to a reverse gamma correction of the red (R) data for providing optimal correction values specifically for the red (R) data. In addition, the G-reverse gamma table 27 may correspond to a reverse gamma correction of the green (G) data for providing optimal correction values specifically for the green (G) data. Further, the B-reverse gamma table 29 may correspond to a reverse gamma correction of the blue (B) data for providing optimal correction values specifically for the blue (B) data. As a result, the signal processor 34 may provide a reverse gamma correction of red (R) data using the R-reverse gamma table 25, a reverse gamma correction of green (G) data using the G-reverse gamma table 27, and a reverse gamma correction of blue (B) data using the B-reverse gamma table 29.

Further, a reverse gamma correction value of each data R, G and B may be adjusted based on conditions, such as a property, a color temperature, a gain or the like of the liquid crystal display panel 22, thereby improving display quality. In addition, since the LUT 36 may be stored in a memory, an operator may easily change the reverse gamma correction values stored in the LUT 36 in order to improve display quality.

Figure 6A:
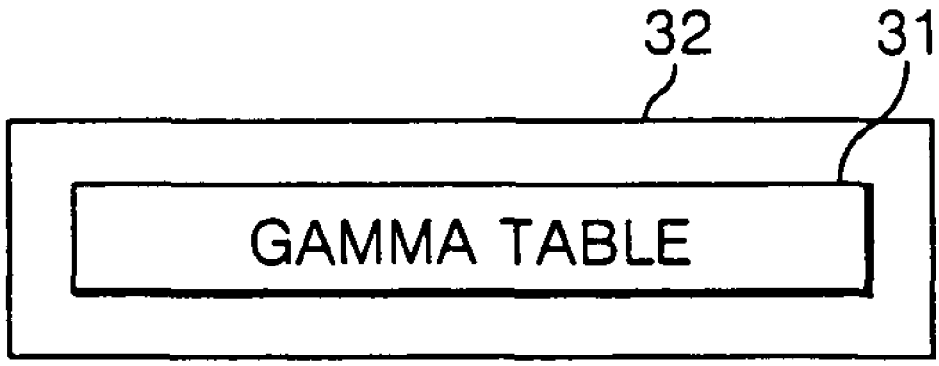
FIG. 6A and FIG. 6B illustrate configurations of the gamma part according to embodiments of the present invention.
Figure 6B:
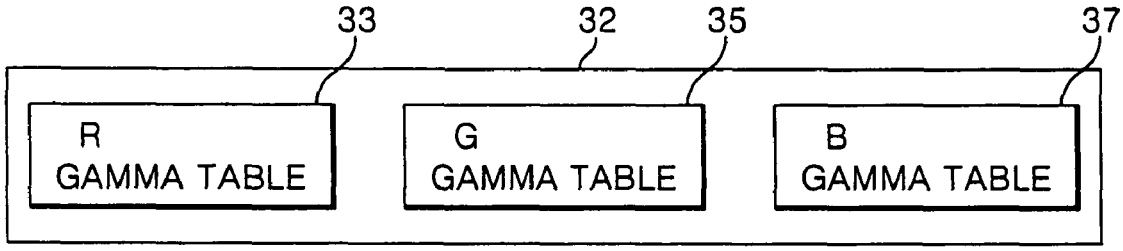

FIG. 6A and FIG. 6B illustrate configurations of the gamma part according to embodiments of the present invention. As shown in FIG. 6A, the gamma part 32 may include a gamma table 31, such that the gamma part 32 may gamma-correct data using a gamma value stored in the gamma table 31. Alternatively, as shown in FIG. 6B, the gamma part 32 may include a plurality of gamma tables, 33, 35, and 37. In particular, the gamma part 32 may gamma-correct red (R) data using a gamma value stored in the R-gamma table 33, may gamma-correct green (G) data using a gamma value stored in the G-gamma table 35, and may gamma-correct blue (B) data using a gamma value stored in the B-gamma table 37. As a result, data that are reverse-gamma-corrected by the three reverse gamma tables 25, 27 and 29 (as shown in FIG. 5B) may be gamma-corrected by the gamma part 32 using the three gamma tables 33, 35 and 37 (as shown in FIG. 6B), such that linear data signals are generated for the data driver 24.

Figure 7:
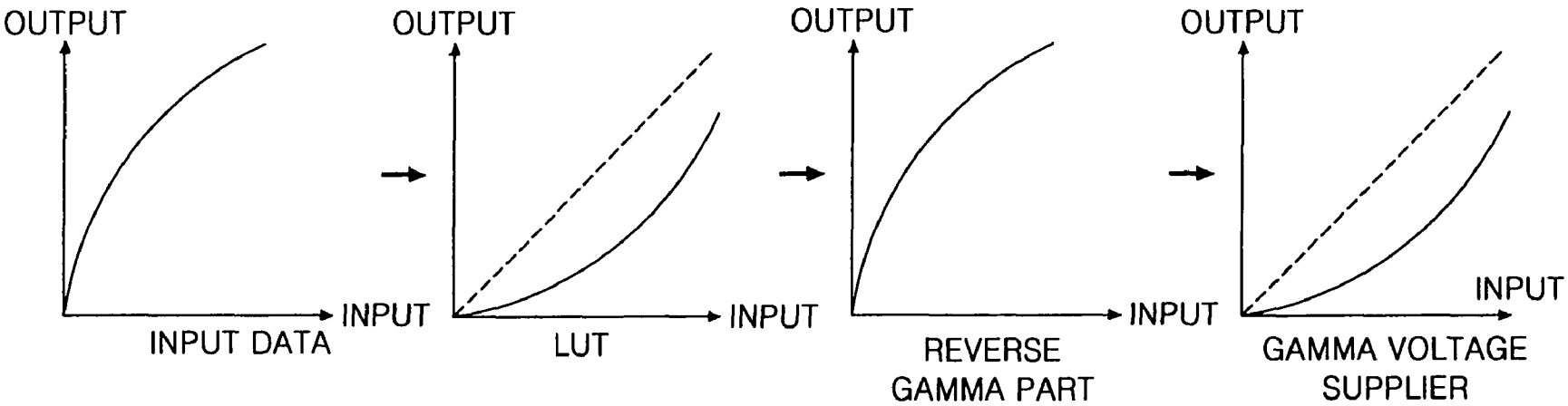
FIG. 7 illustrates gamma characteristics of the data being changed by the driving apparatus for the liquid crystal display in FIG. 3.

FIG. 7 illustrates gamma characteristics of the data being changed by the driving apparatus for the liquid crystal display in FIG. 3. As shown in FIG. 7, a gamma-treated data, e.g., a 2.2 gamma-corrected data, may be received from the input source (not shown). Then, a reverse gamma correction may be performed on the received data by the signal processor 34 (shown in FIG. 3), such that the processed data may have a linear characteristic as shown in the dotted line. Although not specifically shown, the processed data may undergo additional signal processing to improve display quality. Thereafter, the processed data may be reversed-gamma-corrected by the gamma part 32 (shown in FIG. 3). Moreover, the reverse-gamma-corrected data may then be gamma-corrected by the data driver 24 (shown in FIG. 3) using the gamma voltages provided by the gamma voltage supplier 28 (shown in FIG. 3), such that data signals having a linear characteristic may be applied to drive the liquid crystal display panel 22.

Since the data signals applied to the liquid crystal display panel 22 may have a linear characteristic, an image having a linearly increasing gray level may be displayed on the liquid crystal display panel 22. Accordingly, an LCD according to the present invention has an advantage of performing reverse-gamma-correction on the data to provide corrected data having a linear characteristic and performing signal processing on the linear reverse-gamma-corrected data to thereby improve display quality. Thus, the signal processing is performed on data having a linear characteristic without considering data signals to be produced later, so that it becomes possible to make various signal processing for the purpose of improving display quality.

Figure 8:
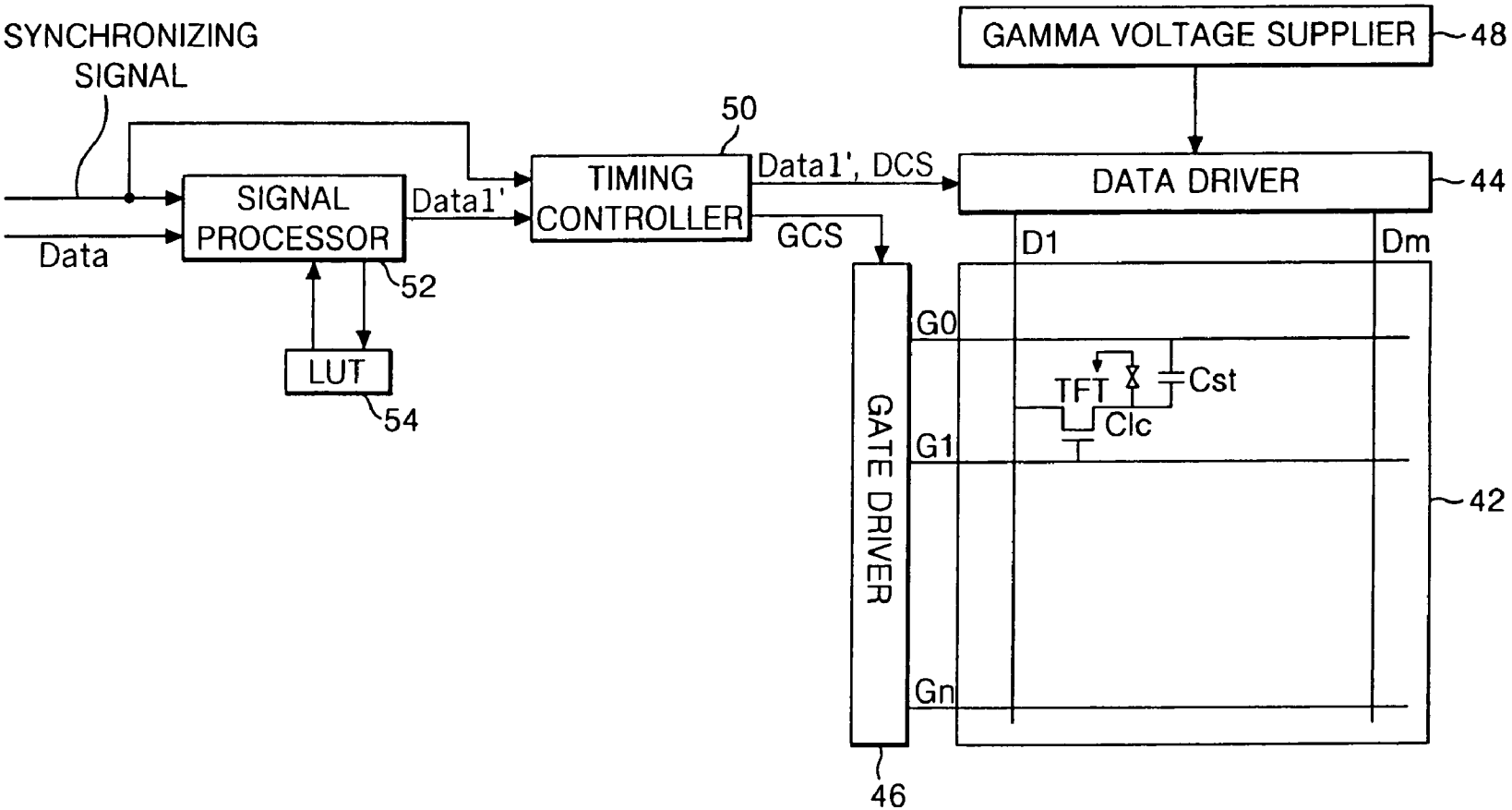
FIG. 8 is a schematic diagram showing a driving apparatus for a liquid crystal display according to another embodiment of the present invention.
Figure 9:
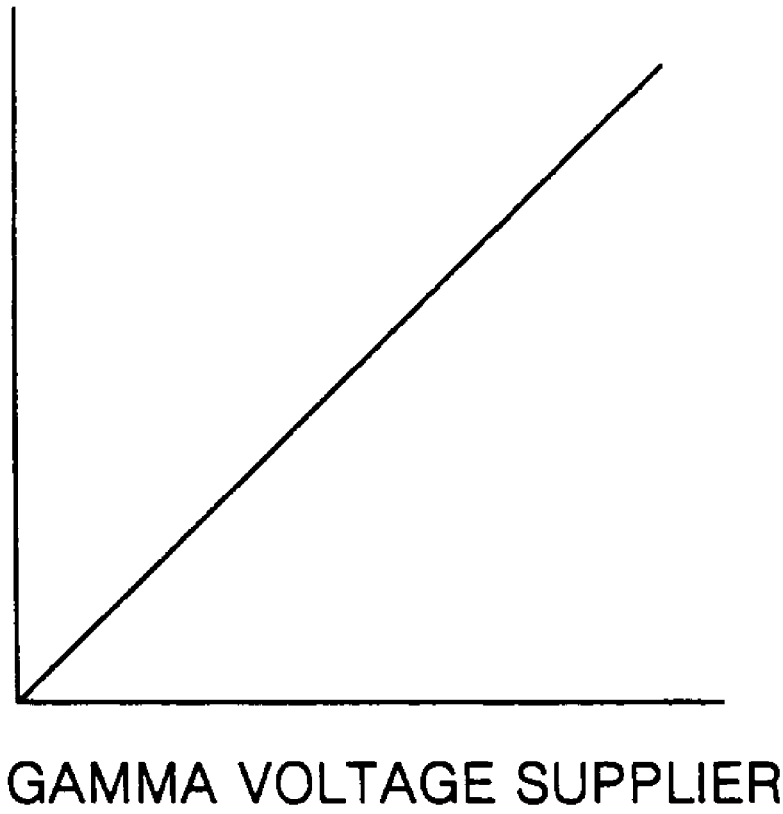
FIG. 9 is a graph representing a gamma value of the gamma voltage supplier in FIG. 8.

FIG. 8 is a schematic diagram showing a driving apparatus for a liquid crystal display according to another embodiment of the present invention, and FIG. 9 is a graph representing a gamma value of the gamma voltage supplier in FIG. 8. In FIG. 8, a driving apparatus for a liquid crystal display device may include a liquid crystal display panel 42, a data driver 44, a gate driver 46, a gamma voltage supplier 48, a timing controller 50, a signal processor 52, and a look-up table (LUT) 54.

The liquid crystal display panel 42 may include m data lines D1 . . . Dm and n gate lines G1 . . . Gn intersecting each other and defining m×n liquid crystal cells Clc arranged in a matrix. The liquid crystal display panel 42 may include a dummy gate line G0. In addition, the liquid crystal display panel 42 may also include thin film transistors TFT and storage capacitors Cst at the m×n liquid crystal cells Clc. The thin film transistors TFT may selectively apply a data signal from the data lines D1 . . . Dm to the respective liquid crystal cells Clc in response to a scanning signal from the gate lines G1 . . . Gn, thereby displaying an image.

In addition, the signal processor 52 may receive gamma-treated data Data having a non-linear characteristic as shown in FIG. 2A from an input source (not shown) and may perform a reverse gamma correction to generate processed data Data1' having a linear characteristic shown as the dotted line in FIG. 4. In particular, the signal processor 52 may use a reverse gamma table stored in the LUT 54 to perform the reverse gamma correction.

The LUT 54 may include a ROM or an EEPROM, and may include one reverse gamma table 23 (as shown in FIG. 5A with respect to the LUT 36). Desired reverse-gamma values may be stored in the reverse gamma table 23, e.g., 2.2 gamma-corrected data have a linear characteristic. As a result, the signal processor 52 may provide a reverse gamma correction of red (R), green (G) and blue (B) data using the reverse gamma table 23. Alternatively, the LUT 54 may include a plurality of reverse gamma tables, 25, 27, and 29 (as shown in FIG. 5B with respect to the LUT 36). As a result, the signal processor 52 may provide a reverse gamma correction of red (R) data using the R-reverse gamma table 25, a reverse gamma correction of green (G) data using the G-reverse gamma table 27, and a reverse gamma correction of blue (B) data using the B-reverse gamma table 29. In addition, since the LUT 54 may be stored in a memory, an operator may easily change the reverse gamma correction values stored in the LUT 54 in order to improve display quality.

Further, before outputting the processed data Data1', the signal processor 52 may perform other signal processing on the reverse-gamma-corrected data, such as adjusting a gain of the data to improve display quality. In particular, types of the signal processing performed by the signal processor 52 need not be restricted because the data undergoing the signal processing have a linear characteristic and may later be converted to a different format, if needed. After performing signal processing on the data, the signal processor 52 may provide the processed data Data1' to the timing controller 50.

The timing controller 50 may then apply the processed data Data1' to the data driver 44. In addition, the timing controller 30 may receive a synchronizing signal from the input source (not shown) and may generate a data control signal DCS and a gate control signal GCS for controlling the data driver 44 and the gate driver 46, respectively.

Moreover, the data driver 44 may convert the processed data Data1' into data signals corresponding to gray level values in response to the data control signal DCS and may apply the data signals to the data lines D1 . . . Dm. In particular, the data driver 44 may generate the data signals using an analog gamma voltage corresponding to the data of a plurality of analog gamma voltages received from the gamma voltage supplier 48.

The gamma voltage supplier 48 may apply the analog gamma voltages to the data driver 44. For example, the gamma voltage supplier 48 may supply the analog gamma voltages having a linear characteristic as shown in FIG. 9 such that the data signals applied to the liquid crystal display panel 42 may have a linear characteristic.

Further, the gate driver 46 may sequentially apply a scanning pulse to the gate lines G1 . . . Gn in response to the gate control signal GCS to thereby selectively drive horizontal lines of the liquid crystal display panel 42.

Figure 10:
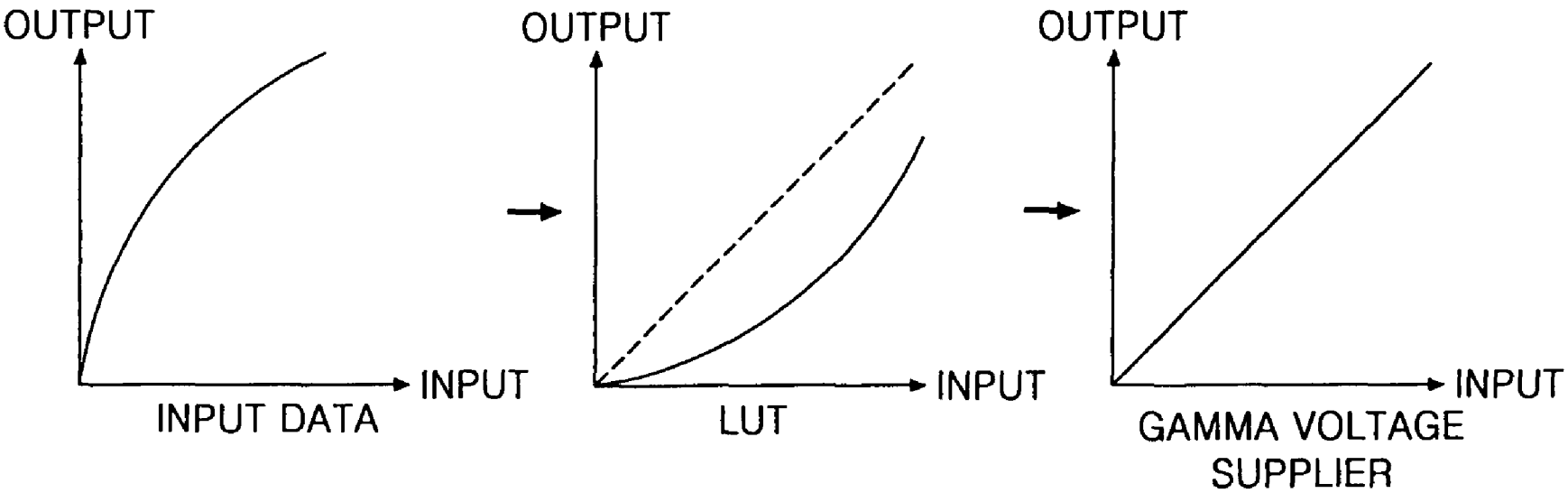
FIG. 10 illustrates gamma characteristics of the data being changed by the driving apparatus for the liquid crystal display in FIG. 8.

FIG. 10 illustrates gamma characteristics of the data being changed by the driving apparatus for the liquid crystal display in FIG. 8. As shown in FIG. 10, a gamma-treated data, e.g., a 2.2 gamma-corrected data, may be received from the input source (not shown). Then, a reverse gamma correction may be performed on the received data by the signal processor 52 (shown in FIG. 8), such that the processed data may have a linear characteristic as shown in the dotted line. Although not specifically shown, the processed data may undergo additional signal processing to improve display quality. Thereafter, the processed data may be converted into data signals using the gamma voltages provided by the gamma voltage supplier 48 (shown in FIG. 8), such that data signals having a linear characteristic may be applied to drive the liquid crystal display panel 42.

Since the data signals applied to the liquid crystal display panel 42 may have a linear characteristic, an image having a linearly increasing gray level may be displayed on the liquid crystal display panel 42. Accordingly, an LCD according to the present invention has an advantage of performing reverse-gamma-correction on the data to provide corrected data having a linear characteristic and performing signal processing on the linear reverse-gamma-corrected data to thereby improve display quality. Thus, the signal processing is performed on data having a linear characteristic without considering data signals to be produced later, so that it becomes possible to make various signal processing for the purpose of improving display quality.

It will be apparent to those skilled in the art that various modifications and variations can be made in the above-discussed method and apparatus for driving a liquid crystal display device without departing from the spirit or scope of the invention. Thus, it is intended that the present invention cover the modifications and variations of this invention provided they come within the scope of the appended claims and their equivalents.

What is claimed is:

1. An apparatus for driving a liquid crystal display device, comprising:

a signal processor receiving gamma-treated data from an input source, and performing a reverse gamma correction on the gamma-treated data to generate reverse-gamma-corrected data having a first linear characteristic, wherein first gamma values are used to treat the gamma-treated data;

a separate look-up table for each color data storing reverse gamma correction values of each red-color data of the gamma-treated data, green-color data of the gamma-treated data and blue-color data of the gamma-treated data;

a gamma means for performing a gamma correction of the reverse-gamma-corrected data using second gamma values to generate second gamma-corrected data;

a timing controller receiving the synchronizing signal from the input source and the second gamma-corrected data from the gamma means, wherein the timing controller generates a data control signal and a gate control signal;

a gamma voltage supplier supplying analog gamma voltages having a second reverse gamma characteristic complementary to a gamma characteristic of the gamma means;

a data driver receiving the second gamma-corrected data from the timing controller and selecting one of the analog gamma voltages from the gamma voltage supplier in correspondence with gray levels of the gamma corrected data to generate analog data signals, wherein each portion of the generated data signal is a linear signal; and a liquid crystal display panel for receiving the analog data signals from the data driver;

wherein the signal processor adjusts a gain of the reverse-gamma-corrected data having the first linear characteristic after performing the reverse gamma correction of the gamma-treated data using the reverse gamma correction values of each red-color data of the gamma-treated data, green-color data of the gamma-treated data and blue-color data of the gamma-treated data stored in the look-up table, and wherein the combination of the gamma characteristics of the gamma means and the second reverse gamma characteristics of the gamma voltage supplier has the second linear characteristic.

2. The apparatus according to claim 1, wherein the reverse gamma correction values are complementary to the first gamma values.

3. The apparatus according to claim 1, wherein said gamma means includes a gamma table for making a gamma correction of red-color data, green-color data and blue-color data of the reverse-gamma-corrected data.

4. The apparatus according to claim 1, wherein said gamma means includes:

a red gamma table for making a gamma correction of red-color data of the reverse-gamma-corrected data;

a green gamma table for making a gamma correction of green-color data of the reverse-gamma-corrected data; and a blue gamma table for making a reverse gamma correction of blue-color data of the reverse-gamma-corrected data.

5. The apparatus according to claim 2, wherein the look-up table includes a reverse gamma correction table for making a reverse gamma correction of red-color data, green-color data and blue-color data of the gamma-treated data.

6. The apparatus according to claim 2, wherein said look-up table includes:

a red reverse gamma correction table for making a reverse gamma correction of red-color data of the gamma-treated data;

a green reverse gamma correction table for making a reverse gamma correction of green-color data of the gamma-treated data; and a blue reverse gamma correction table for making a reverse gamma correction of blue-color data of the gamma-treated data.

7. The apparatus according to claim 2, wherein the look-up table is stored in a memory.

8. A method of driving a liquid crystal display device, comprising:

receiving gamma-treated data and a synchronizing signal from an input source, the gamma-treated data treated using first gamma values;

performing a reverse gamma correction of the gamma-treated data by a signal processor using the reverse gamma correction values of each red-color data of the gamma-treated data, green-color data of the gamma-treated data and blue-color data of the gamma-treated data stored in a separate look-up table for each color data, the reverse-gamma-corrected data having a first linear characteristic;

adjusting a gain of the reverse-gamma-corrected data having the first linear characteristic by the signal processor;

performing a gamma correction of the processed data using second gamma values to generate second gamma-corrected data by gamma means;

receiving, by a timing controller, the synchronizing signal from the input source and the second gamma-corrected data from the gamma means, wherein the timing controller generates a data control signal and a gate control signal;

supplying analog gamma voltages having a second reverse gamma characteristic complementary to a gamma characteristic of the gamma means by a gamma voltage supplier; and generating data signals based on the gamma-corrected data using the analog gamma voltage by a data driver, wherein each portion of the generated data signals are linear signals, wherein the combination of the gamma characteristics of the gamma means and the second reverse gamma characteristics of the gamma voltage supplier has the second linear characteristic.

9. The method according to claim 8, wherein the step of performing the gamma correction includes using a gamma value stored in at least one look-up table.

* * * * *